US011549272B2

(12) United States Patent
Klaus

(10) Patent No.: US 11,549,272 B2
(45) Date of Patent: Jan. 10, 2023

(54) SLIP FORM CONSTRUCTION SYSTEMS AND METHODS FOR USE

(71) Applicant: KLAUS AND ASSOCIATES, INC., Highland, IL (US)

(72) Inventor: Harold Paul Klaus, Highland, IL (US)

(73) Assignee: KLAUS AND ASSOCIATES, INC., Highland, IL (US)

( * ) Notice: Subject to any disclaimer, the term of this patent is extended or adjusted under 35 U.S.C. 154(b) by 499 days.

(21) Appl. No.: 16/726,494

(22) Filed: Dec. 24, 2019

(65) Prior Publication Data

US 2021/0189743 A1 Jun. 24, 2021

(51) Int. Cl.
*E04G 11/24* (2006.01)

(52) U.S. Cl.
CPC ..... *E04G 11/24* (2013.01)

(58) Field of Classification Search
CPC ..... E04G 11/24; E04G 11/22; E04G 11/20
See application file for complete search history.

(56) References Cited

U.S. PATENT DOCUMENTS

| | | | |
|---|---|---|---|
| 1,235,542 | A | 8/1917 | Bagby |
| 1,393,506 | A | 9/1920 | Copeland |
| 1,375,109 | A | 4/1921 | Rossiter |
| 1,554,420 | A | 9/1925 | Donley |
| 3,510,098 | A | 5/1970 | Fox |
| 3,638,901 | A | 2/1972 | Williams |
| 3,778,204 | A | 12/1973 | Kuck |
| 3,897,182 | A | 7/1975 | Heinzle |
| 3,966,376 | A | 6/1976 | Heinzle |
| 4,108,583 | A | 8/1978 | Ellen |
| 4,122,648 | A | 10/1978 | Godwin |
| 4,253,810 | A | 3/1981 | Bezhanov et al. |
| 4,312,492 | A | 1/1982 | Andersson |
| 5,012,627 | A | 5/1991 | Landmark |
| 5,198,235 | A | 3/1993 | Reichstein |

(Continued)

FOREIGN PATENT DOCUMENTS

| | | | |
|---|---|---|---|
| EP | 0982449 A1 | 3/2000 | |
| EP | 2090718 A2 * | 8/2009 | ..... E04G 11/22 |

(Continued)

OTHER PUBLICATIONS

Translation of JP H0726898 A. (Year: 1995).*
Translation of EP 2090718 A2. (Year: 2009).*

*Primary Examiner* — Michael Safavi
(74) *Attorney, Agent, or Firm* — Armstrong Teasdale LLP

(57) ABSTRACT

A slip form assembly includes a lifting pole extending in a longitudinal direction and an inner form slidably coupled to the lifting pole and extending in a lengthwise direction perpendicular to the longitudinal direction between a first end and a second end. The first end is configured for end-to-end contact with an adjacent end of an adjacent inner form. An outer form is slidably coupled to the lifting pole opposite the inner form and defines a cavity for casting a portion of a wall therebetween. The outer form extends parallel to the inner form between a first end and a second end. The first end of the outer form is configured for end-to-end contact with an adjacent end of an adjacent outer form. The inner form and outer form are moveable along the lifting pole longitudinally relative to the respective ends of the adjacent inner form and outer form.

20 Claims, 12 Drawing Sheets

(56) References Cited

U.S. PATENT DOCUMENTS

| | | | | |
|---|---|---|---|---|
| 5,263,835 | A | 11/1993 | Schmidt | |
| 6,260,311 | B1 | 7/2001 | Vladikovic | |
| 7,004,737 | B2 * | 2/2006 | Russell | E04G 11/22 249/20 |
| 7,503,151 | B2 | 3/2009 | Simmons | |
| 8,621,817 | B1 | 1/2014 | Kreizinger | |
| 9,375,861 | B2 | 6/2016 | Schibsbye | |
| 9,388,598 | B2 | 7/2016 | Stiesdal | |
| 9,587,413 | B2 | 3/2017 | Horn et al. | |

FOREIGN PATENT DOCUMENTS

| | | | | |
|---|---|---|---|---|
| JP | H0726898 | A * | 8/2009 | E04G 11/24 |
| WO | 2014062062 | A1 | 4/2014 | |

* cited by examiner

SLIP FORM CONSTRUCTION SYSTEMS AND METHODS FOR USE

BACKGROUND

The field of the disclosure relates generally to construction systems and, more particularly, to slip form assemblies for use in slip form construction systems.

At least some known construction systems typically involve precast forms used for forming concrete. For example, at least some known construction systems utilize "tilt-up panels", which generally utilize using wood forms, rebar and concrete. The "tilt-up panels" are shaped to match the desired design shape of an exterior wall of a building and may be either built at a work site or precast prior to arriving at the work site. During construction, concrete is poured into the tilt-up panels, with the panels oriented in a "face-down" position (i.e., such that the walls are oriented horizontally). After the concrete is cast and hardened in the forms, the walls are tilted into a vertical orientation (e.g., via a lifting crane) and set on foundational footings to form an exterior structure of a building. As a result, at least some known construction systems are generally costly to implement and are sensitive to surrounding weather when erecting the tilt-up panels.

Furthermore, at least some known construction systems utilize forms for pouring and casting the concrete walls in the vertical orientation. For example, at least some known construction systems utilize form panels positioned on both sides of a poured wall and surrounding a perimeter of the wall. Such form systems generally require high lifting capacity to uniformly lift the forms and, for example, additional work platforms coupled to the forms, about the entire perimeter of a building during construction. As a result, at least some known construction systems are generally cost prohibitive to implement in the construction of small to midsize structures (e.g., 60 feet and below).

Accordingly, it would be desirable to provide a construction system that allows for simpler and less costly construction of concrete walls for a structure.

BRIEF DESCRIPTION

In one aspect, a slip form assembly for use in a slip form construction system is provided. The slip form assembly includes a lifting pole extending in a longitudinal direction and an inner form slidably coupled to the lifting pole and extending in a lengthwise direction perpendicular to the longitudinal direction between a first end and a second end. The first end is configured for end-to-end contact with an adjacent end of an adjacent inner form. The slip form assembly also includes an outer form slidably coupled to the lifting pole opposite the inner form and defines a cavity for casting a portion of a wall therebetween. The outer form extends parallel to the inner form between a first end and a second end, the first end of the outer form configured for end-to-end contact with an adjacent end of an adjacent outer form. The inner form and the outer form are moveable along the lifting pole in the longitudinal direction relative to the respective ends of the adjacent inner form and outer form.

In another aspect, a slip form construction system is provided. The slip form construction system includes a first slip form assembly including a first lifting pole extending in a longitudinal direction, a first inner form slidably coupled to the first lifting pole, and a first outer form slidably coupled to the first lifting pole opposite the first inner form. The first inner form and first outer form define a first cavity for casting a first portion of a wall therebetween. The slip form construction system also includes a second slip form assembly including a second lifting pole extending in the longitudinal direction, a second inner form slidably coupled to the second lifting pole, and a second outer form slidably coupled to the second lifting pole opposite the second inner form. The second inner form and second outer form define a second cavity in fluid communication with the first cavity for casting a second portion of the wall therebetween. The first inner form and the first outer form are moveable about the first lifting pole in the longitudinal direction to facilitate moving the first inner form and the first outer form in the longitudinal direction relative to the second inner form and the second outer form.

In yet another aspect, a method of assembling a concrete wall is provided. The method includes providing a first slip form assembly. The first slip form assembly includes a first lifting pole extending in a longitudinal direction, a first inner form and a first outer form each slidably coupled to the first lifting pole and defining a first cavity therebetween. The method also includes providing a second slip form assembly. The second slip form assembly includes a second lifting pole, a second inner form and a second outer form each slidably coupled to the second lifting pole and defining a second cavity in fluid communication with the first cavity therebetween. The method further includes providing a concrete material within at least one of the first cavity and the second cavity and selectively moving the first inner form and the first outer form in the longitudinal direction relative to the second inner form and the second outer form.

DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

Embodiments described herein relate to slip form construction systems and slip form assemblies for slip form construction systems. The slip form assemblies each include a lifting pole extending in a longitudinal direction and an inner form and outer form each slidably coupled to the lifting pole and configured for end-to-end contact with adjacent ends of respective adjacent inner forms and outer forms. The inner forms and outer forms are moveable in the longitudinal direction relative to the respective ends of adjacent inner forms and outer forms. As a result, the slip form assemblies and slip form construction systems reduce costs and down time associated with constructing a concrete structure. In particular, the slip form assemblies and slip form construction systems described herein allow for independent lifting of slip form assemblies relative to one another, thereby reducing the total load on lifting mechanisms when raising the slip form assemblies. In addition, the independent lifting of slip form assemblies reduces downtime by enabling different lifting, pouring, molding, and casting processes to be performed simultaneously on different parts of the concrete structure.

Figure 1:
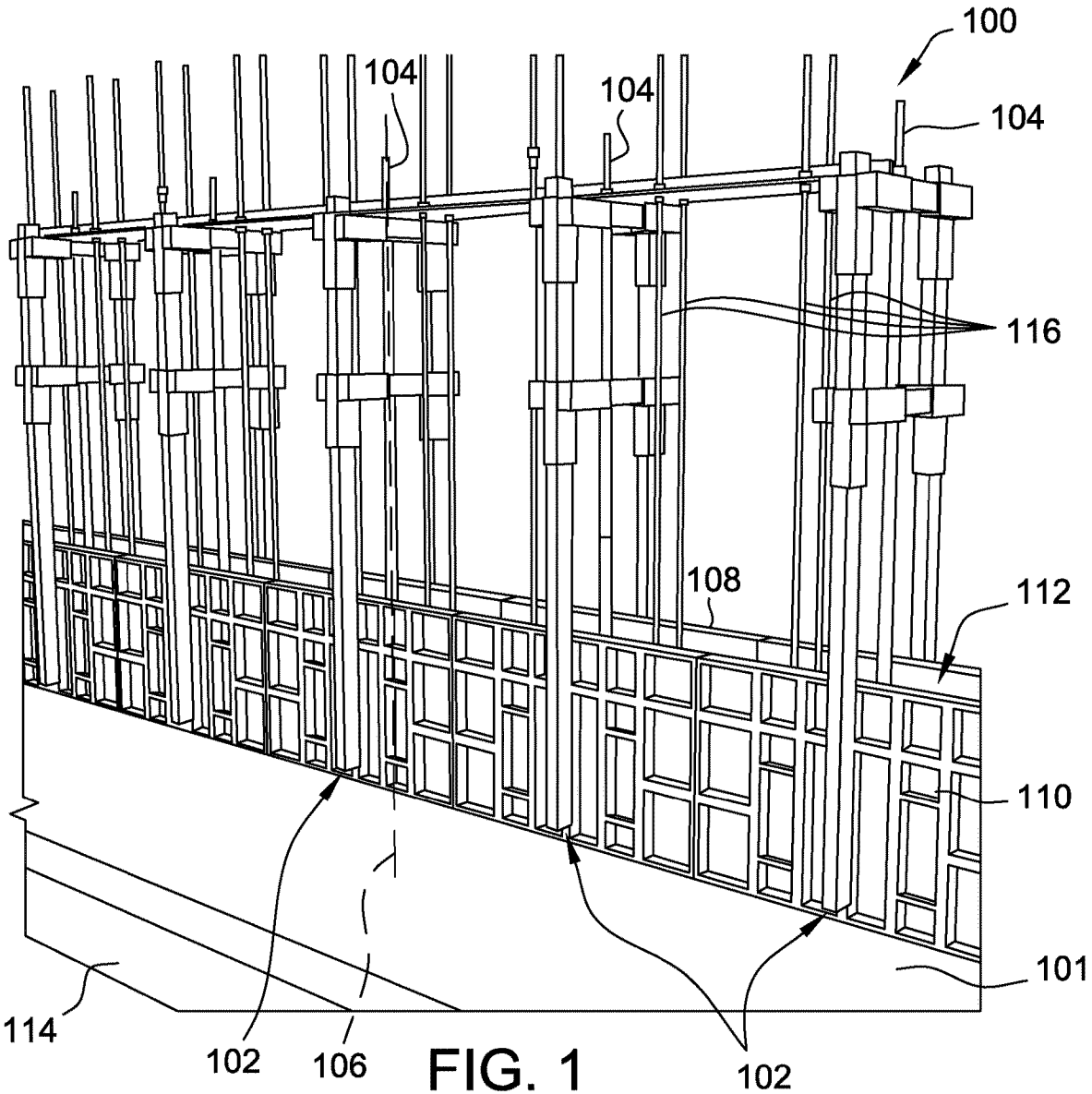
FIG. 1 is a schematic view of a portion of an exemplary slip form construction system including a plurality slip form assemblies.

FIG. 1 is a schematic view of a portion of an exemplary slip form construction system 100 including a plurality slip form assemblies 102. In the exemplary embodiment, slip form construction system 100 is configured to vertically construct a concrete wall 101. Slip form assemblies 102 each include a lifting pole 104 extending along a longitudinal axis, indicated generally at 106, an inner form 108 slidably coupled to lifting pole 104, and an outer form 110 slidably coupled to lifting pole 104 opposite inner form 108. Inner form 108 and outer form 110 define a cavity 112 therebetween for casting concrete wall. In particular, as shown in FIG. 1, five slip form assemblies 102 extend along a portion of concrete wall 101. Additional slip form assemblies extending along the entire wall 101 are not shown for clarity.

In the exemplary embodiment, slip form construction system 100 is configured to be positioned upon a portion of a foundation 114 and to build concrete wall 101 up from foundation 114. More specifically, in the exemplary embodiment, slip form assemblies 102 are configured to receive moldable concrete poured into cavity 112. Inner form 108 and outer form 110 are configured to mold concrete into a hardened uniform concrete wall 101. In the exemplary embodiment, inner forms 108 and outer forms 110 are configured to slidably engage concrete wall 101 to facilitate forming concrete wall 101. More specifically, inner forms 108 and outer forms 110 are configured to retain poured concrete within the cavity 112 such that concrete wall 101 has a substantially uniform width throughout. Additionally, inner forms and outer forms 108, 110 are configured to be incrementally moved longitudinally along lifting pole 104 as poured concrete hardens to form poured concrete vertically on top of hardened concrete.

In the exemplary embodiment, slip form construction system 100 includes a plurality of reinforcing bars 116 extending vertically through concrete wall 101 and configured to provide structural support for concrete wall 101 when completed. In alternative embodiments, slip form construction system 100 further includes insulation panels (not shown) positioned within the cavity 112 and configured to be molded into concrete wall 101 during construction.

Figure 2:
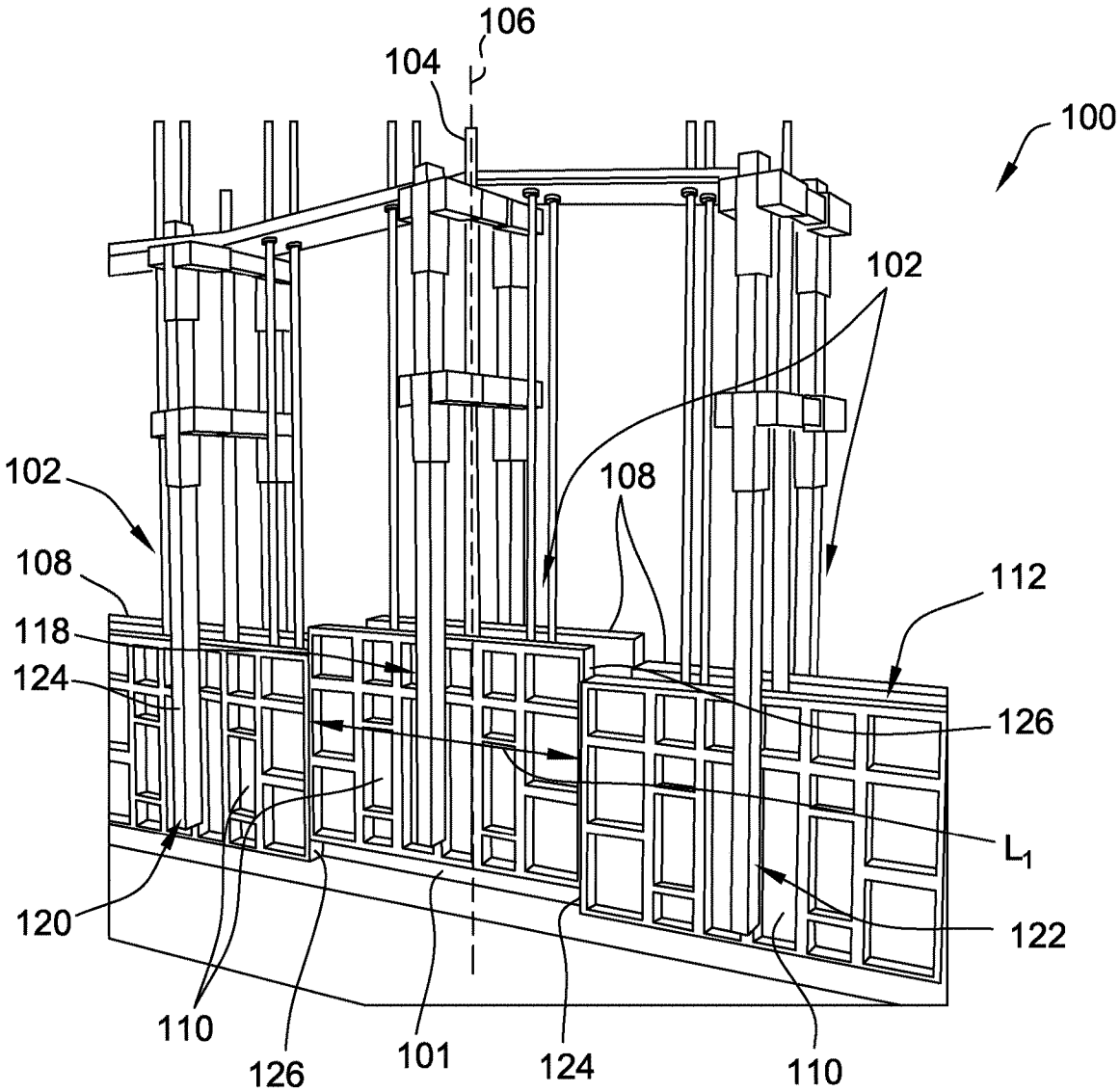
FIG. 2 is a schematic view of the slip form construction system shown in FIG. 1 including a first slip form assembly in a raised position relative to adjacent slip form assemblies.

FIG. 2 is a schematic view of slip form construction system 100 shown in FIG. 1 including a first slip form assembly 118 in a raised position relative to adjacent slip form assemblies 120, 122. In the exemplary embodiment, slip form construction system 100 includes first slip form assembly 118 positioned between a second slip form assembly 120 and a third slip form assembly 122. Inner forms 108 each extend a length, indicated generally at L1, in a lengthwise direction perpendicular to the longitudinal direction, between a first end 124 and a second end 126. Likewise, outer forms 110 each extend a length (not shown) in a direction parallel to the lengths of opposing inner forms 108 between a first end 124 and a second end 126. In particular, in the exemplary embodiment, inner forms 108 and outer forms 110 have approximately the same length. In alternative embodiments, inner forms 108 and outer forms 110 are sized in any manner that enables slip form construction system 100 to operate as described herein. For example, and without limitation, in some alternative embodiments, an outer form (not shown) has a greater length than its corresponding inner form (not shown) to facilitate forming an arced portion of a perimeter of a concrete wall 101.

Figure 9:
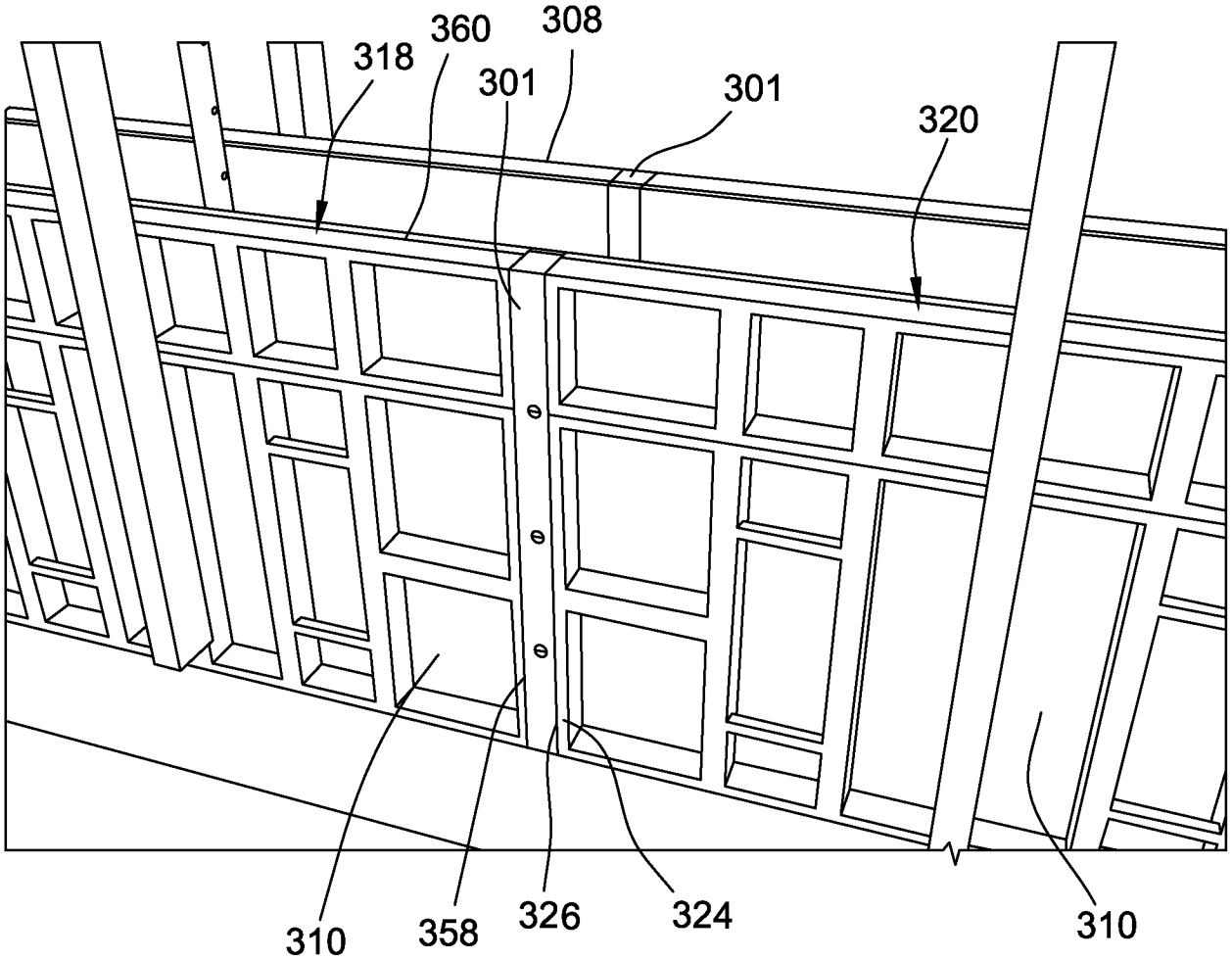
FIG. 9 is a schematic, perspective view of an alternative slip form assembly for use in the slip form construction system of FIG. 1.

In the exemplary embodiment, first end 124 and second end 126 of inner forms 108 and outer forms 110 are positioned in end-to-end contact with adjacent ends of respective adjacent inner forms 108 and outer forms 110 such that slip form assemblies 118, 120, 122 extend continuously along the entire perimeter of concrete wall 101 and inhibit concrete poured into cavity 112 from escaping between slip form assemblies 118, 120, 122. In alternative embodiments, slip form construction system 100 includes additional features positioned between forms 108, 110 of adjacent slip form assemblies 118, 120, 122. For example, and without limitation, as shown in FIG. 9, in some alternative embodiments, a roller assembly 301 is coupled between ends 324, 326 of forms 310 of adjacent slip form assemblies 318, 320.

In the exemplary embodiment, inner form 108 and outer form 110 of each slip form assembly 118, 120, 122 are moveable about their respective lifting poles 104 in the longitudinal direction 106 to facilitate moving forms 108, 110 of each slip form assembly 118, 120, 122 relative to adjacent forms 108, 110, and more particularly, relative to adjacent ends 124, 126 of adjacent forms 108, 110, of adjacent slip form assemblies 118, 120, 122. For example, in the exemplary embodiment, first slip form assembly 118 is longitudinally raised (e.g., approximately 6 inches) relative to second slip form assembly 120 and third slip form assembly 122. In the raised position, first end 124 of outer form 110 of first slip form assembly 118 is, at least partially, in end-to end contact with, and extends above, second end 126 of outer form 110 of second slip form assembly 120. Likewise, second end 126 of outer form 110 of first slip form assembly 118 is, at least partially, in end-to-end contact with, and extends above, first end 124 of outer form 110 of third slip form assembly 122.

During operation (i.e., construction of concrete wall 101), concrete is incrementally poured into cavity 112 from a pouring device (not shown) situated above forms 108, 110. As the poured concrete hardens within cavity 112, inner form 108 and outer form 110 of each slip form assembly 118, 120, 122 are moved vertically in the longitudinal direction 106 to expose hardened portions of concrete wall 101 below forms 108, 110, and to receive additional moldable concrete on top of concrete wall 101 to progressively build up concrete wall 101. In particular, in the exemplary embodiment, slip form assemblies 102 may be raised independently of one another to facilitate lifting the individual slip form assemblies 102 based on a localized hardening state of concrete previously poured within cavities 112 of the respective slip form assembly 118, 120, 122.

Figure 3:
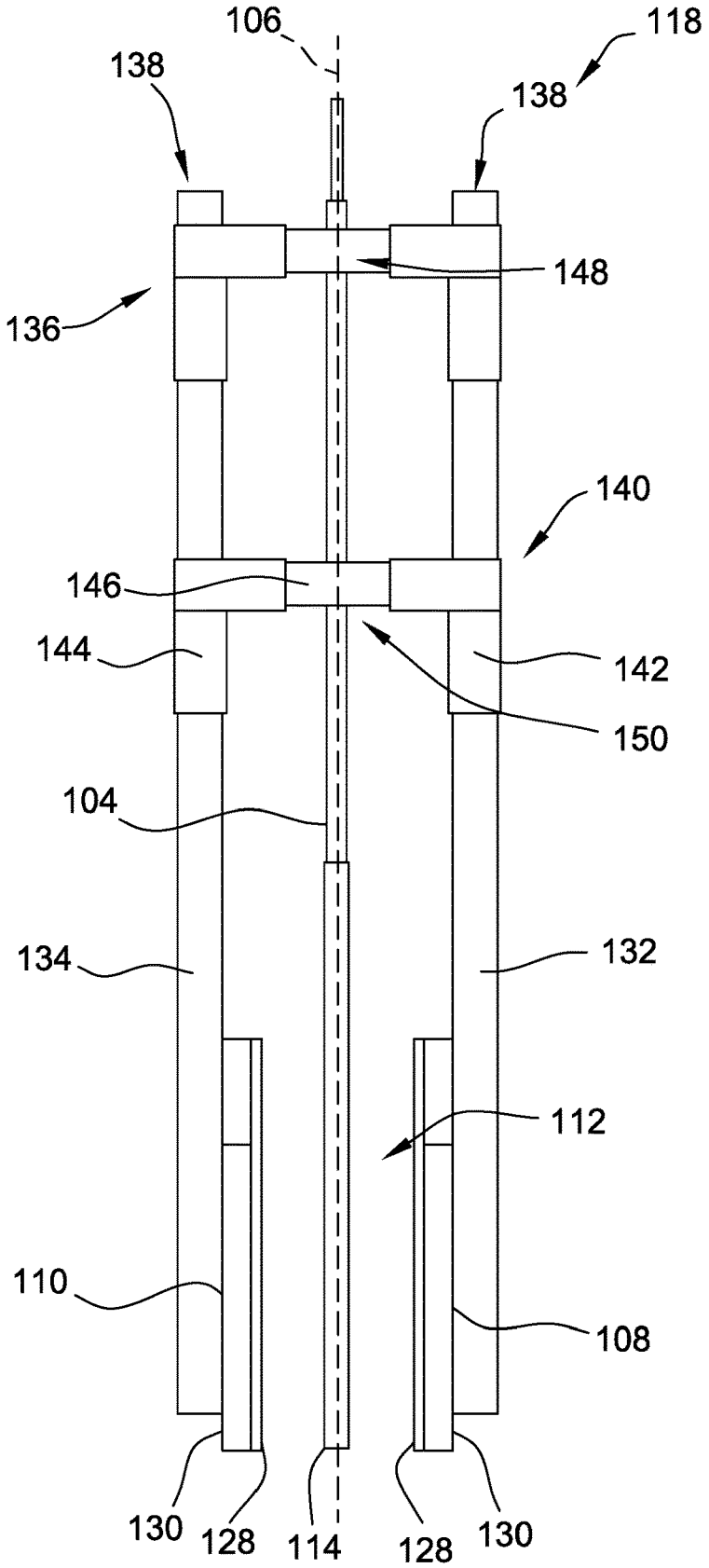
FIG. 3 is a schematic, end view of the first slip form assembly shown in FIG. 2.

FIG. 3 is a schematic, end view of first slip form assembly 118 shown in FIG. 2. In the exemplary embodiment, forms 108, 110 each extend between respective inner surfaces 128 oriented to face one another, and opposed outer surfaces 130. In the exemplary embodiment, slip form assembly includes an inner yoke 132 fixedly coupled to outer surface 130 of inner form 108. Inner yoke 132 extends vertically from outer surface 130 of inner form 108 in the longitudinal direction 106. First slip form assembly 118 further includes an outer yoke 134 fixedly coupled to outer surface 130 of outer form 110. Outer yoke 134 extends vertically from outer surface 130 of outer form 110 in the longitudinal direction 106 parallel to inner yoke 132. In alternative embodiments, inner yoke 132 and outer yoke 134 are coupled to inner form 108 and outer form 110 respectively in any manner that enabled first slip form assembly 118 to function as described herein.

In the exemplary embodiment, first slip form assembly 118 further includes a plurality of spreader assemblies 136, 140 coupled to inner yoke 132 and outer yoke 134 and extending therebetween in a direction substantially perpendicular to the longitudinal direction. In particular, in the exemplary embodiment, first slip form assembly 118 includes a first spreader assembly 136 coupled to inner yoke 132 and outer yoke 134 at respective upper free ends 138 of inner yoke 132 and outer yoke 134. A second spreader assembly 140 is coupled to inner yoke 132 and outer yoke 134 vertically (i.e., in the longitudinal direction) below first spreader assembly 136. In alternative embodiments, first slip form assembly 118 includes any number of spreader assemblies 136, 140 that enable first slip form assembly 118 to function as described herein. For example, and without limitation, in some alternative embodiments, first slip form assembly 118 includes a third spreader assembly (not shown) fixedly coupled to inner yoke 132 and outer yoke 134 adjacent inner form 108 and outer form 110 respectively.

In the exemplary embodiment, spreader assemblies 136, 140 each include an inner bracket 142 fixedly coupled to inner yoke 132, an outer bracket 144 fixedly coupled to outer yoke 134, and a spreader bar 146 fixedly coupled to inner bracket 142 and outer bracket 144 and sized to extend therebetween. In the exemplary embodiment, spreader assemblies 136, 140 are configured to engage inner yoke 132 and outer yoke 134 to retain inner form 108 and outer form 110 at a substantially constant distance from one another to facilitate maintaining a substantially uniform width of concrete wall 101 (shown in FIG. 2) during construction. In addition, in the exemplary embodiment, spreader bars 146 are selectively removable from brackets 142, 144 to facilitate coupling, for example, spreader bars 146 of differing lengths to brackets 142, 144 to facilitate forming concrete walls of differing sizes (e.g., forming other concrete walls and/or portions of concrete wall 101 (not shown) having larger and/or smaller widths and thereby requiring greater or lesser spacing between inner forms 108 and outer forms 110). In the exemplary embodiment, spreader bars 146 each define an opening 148, 150 sized to receive a portion of lifting pole 104 extending therethrough.

In the exemplary embodiment, lifting pole 104 extends through a first opening 148 defined in first spreader assembly 136 and a second opening 150 defined in second spreader assembly 140. In the exemplary embodiment, lifting pole 104 is configured to be selectively mounted to foundation 114 (shown in FIG. 2) to maintain extension of lifting pole 104 in the longitudinal direction 106. More specifically, lifting pole 104 is configured to vertically guide first slip form assembly 118 during construction of concrete wall 101 (shown in FIG. 1).

In alternative embodiments, first slip form assembly 118 includes a work platform (not shown) coupled to at least one of inner yoke 132 and outer yoke 134. For example, and without limitation, in such embodiments, the work platforms are positioned along one of inner yoke 132 and outer yoke 134 to enable operators to work on concrete freshly poured into cavity 112 (e.g., smoothing/vibrating freshly poured concrete). In further alternative embodiments, the work platforms extend continuously between slip form assemblies 102 (shown in FIG. 1) such that operators may traverse the entire perimeter of concrete wall 101 on the work platforms. In such embodiments, a gap (not shown) is defined between the work platforms of adjacent slip form assemblies 102 (shown in FIG. 1) to facilitate independent longitudinal movement of forms 108, 110 relative to one another. In further alternative embodiments, the work platforms (not shown) of adjacent slip form assemblies 102 (shown in FIG. 1) are hingedly coupled to one another. In yet further alternative embodiments, the work platforms may be coupled to first slip form assembly 118 in any manner that enables the work platforms to function as described herein. In yet further embodiments, powered lifts e.g., telehandlers, are used to position crews relative to concrete wall 101 (shown in FIG. 2) during construction.

Figure 4:
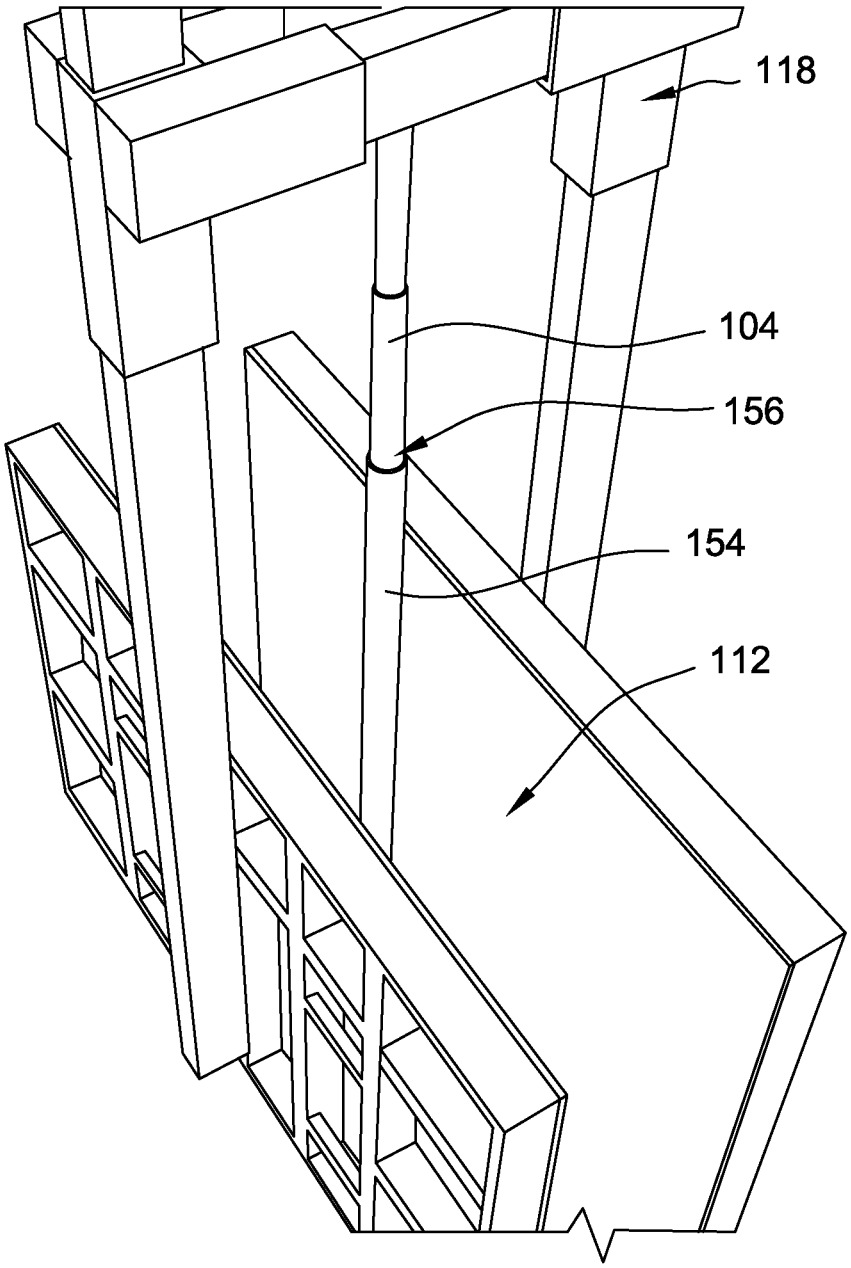
FIG. 4 is schematic, perspective view of a portion of the slip form assembly shown in FIG. 3.

FIG. 4 is schematic, perspective view of a portion of first slip form assembly 118 shown in FIG. 3. In the exemplary embodiment, first slip form assembly 118 includes a shielding sleeve 154 configured to surround at least a portion of lifting pole 104 to inhibit poured concrete from hardening around lifting pole 104. More specifically, shielding sleeve 154 is substantially hollow and defines a channel 156 sized to receive at least a portion of lifting pole 104 therein. During construction of concrete wall 101 (shown in FIG. 1), shielding sleeve 154 is located at the base of lifting pole 104. As concrete is poured into cavity 112, shielding sleeve 154 inhibits concrete from coming into contact with lifting pole 104. As concrete hardens and first slip form assembly 118 is raised, shielding sleeve 154 is raised in the longitudinal direction in correspondence with first slip form assembly 118, thereby shielding portions of lifting pole 104 as they are freshly exposed to poured concrete and revealing a cavity (not shown) between lifting pole 104 and hardened concrete below shielding sleeve 154. At least in part due to the cavity formed between lifting pole 104 and hardened concrete as a result of shielding sleeve 154, lifting pole 104 is selectively removable from concrete wall 101 (shown in FIG. 1), for example, after concrete wall 101 (shown in FIG. 1) is constructed. In the exemplary embodiment, shielding sleeve 154 is formed of polyvinyl chloride (PVC). In alternative embodiments, shielding sleeve 154 is formed of any material that enables shielding sleeve 154 to function as described herein.

Figure 5:
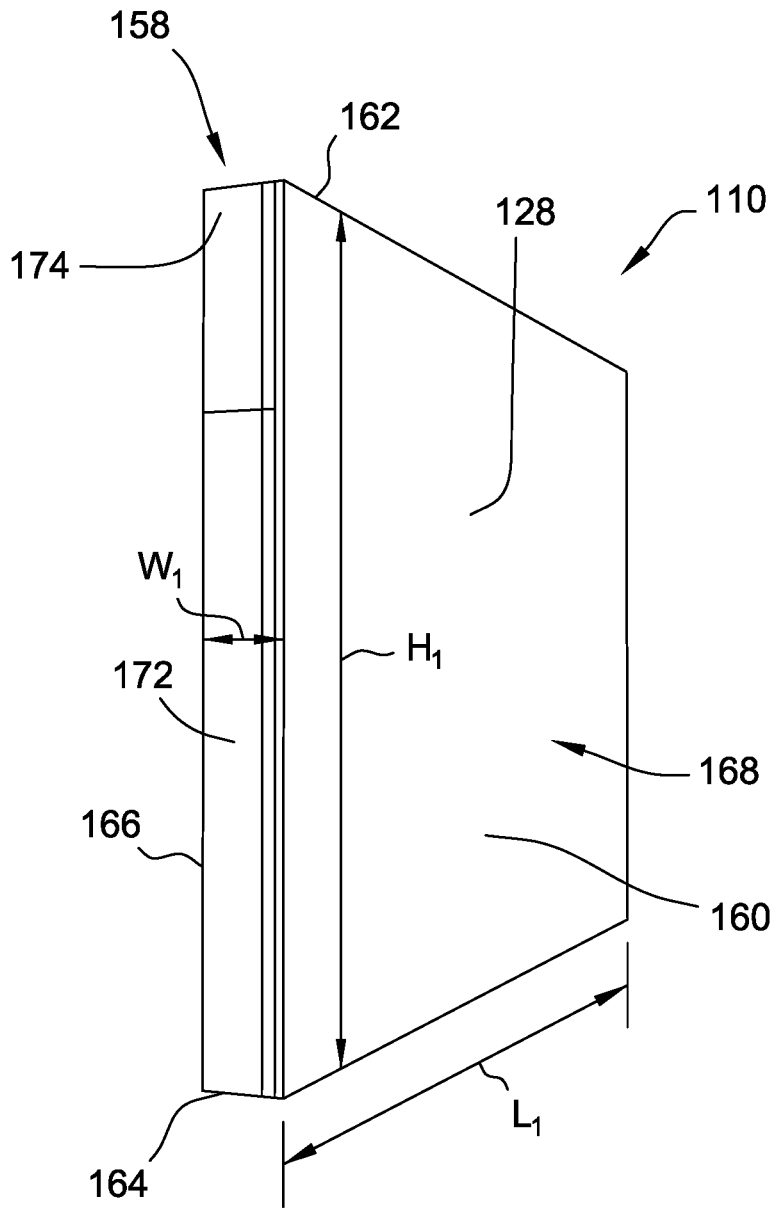
FIG. 5 is a schematic, perspective view of an outer form for use in the slip form assembly shown in FIG. 3.

FIG. 5 is a schematic, perspective view of outer form 110 for use in first slip form assembly 118 shown in FIG. 3. In the exemplary embodiment, outer form 110 includes a form body 158 and a surface panel 160 coupled to form body 158. Outer form 110 includes a top 162, a bottom 164 opposite top 162, a first side 166, and a second side 168 opposite first side 166. Second side 168 includes inner surface 128. Inner surface 128 is configured to face cavity 112 (shown in FIG. 1) and form concrete poured into cavity 112. Outer form 110 extends a height, generally indicated at H1 between top 162 and bottom 164. Outer form 110 extends a width, indicated generally at W1, between first side 166 and second side 168. In the exemplary embodiment, height H1 of outer form 110 is approximately four feet, width W1 of outer form 110 is 4.75 inches, and length L1 of outer form 110 is approximately 6 feet. In alternative embodiments, outer form 110 is sized in any manner that enables first slip form assembly 118 (shown in FIG. 5) to function as described herein.

In the exemplary embodiment, surface panel 160 defines inner surface 128 of outer form 110. More specifically in the exemplary embodiment, surface panel 160 extends along the entire second side 168 of outer form 110 such that, during operation, surface panel 160 directly contacts concrete poured into cavity (shown in FIG. 5). In the exemplary embodiment surface panel 160 is formed of a material configured to have a low coefficient of friction with concrete to facilitate slidably moving outer form 110 in the longitudinal direction relative to poured and hardened concrete during operation. In particular, in the exemplary embodiment, surface panel 160 is formed of an ultra-high molecular weight ("UHMW") polyethylene. In other embodiments, surface panel 160 is formed of any material that enables surface panel 160 to function as described herein.

In the exemplary embodiment, form body 158 includes a first form panel 172 and a second form panel 174 coupled to, and positioned above first form panel 172. In particular, in the exemplary embodiment, a coupling mechanism, e.g., a clamp (not shown), engages first form panel 172 and second form panel 174 to maintain first form panel 172 and second form panel 174 as a rigid unit. In alternative embodiments, first form panel 172 and second form panel 174 are coupled in any manner that enables outer form 110 to function as described herein. In the exemplary embodiment, first form panel 172 and second form panel 174 are directly coupled to surface panel 160. In alternative embodiments, outer form 110 does not include second form panel 174. For example, and without limitation, in some such embodiments, first form panel 172 extends the entire height of surface panel 160. While the description herein is directed to outer form 110, it will be understood that inner forms 108 (shown in FIG. 3) of first slip form assembly 118 may be constructed in substantially the same manner described with respect to outer form 110.

Figure 6:
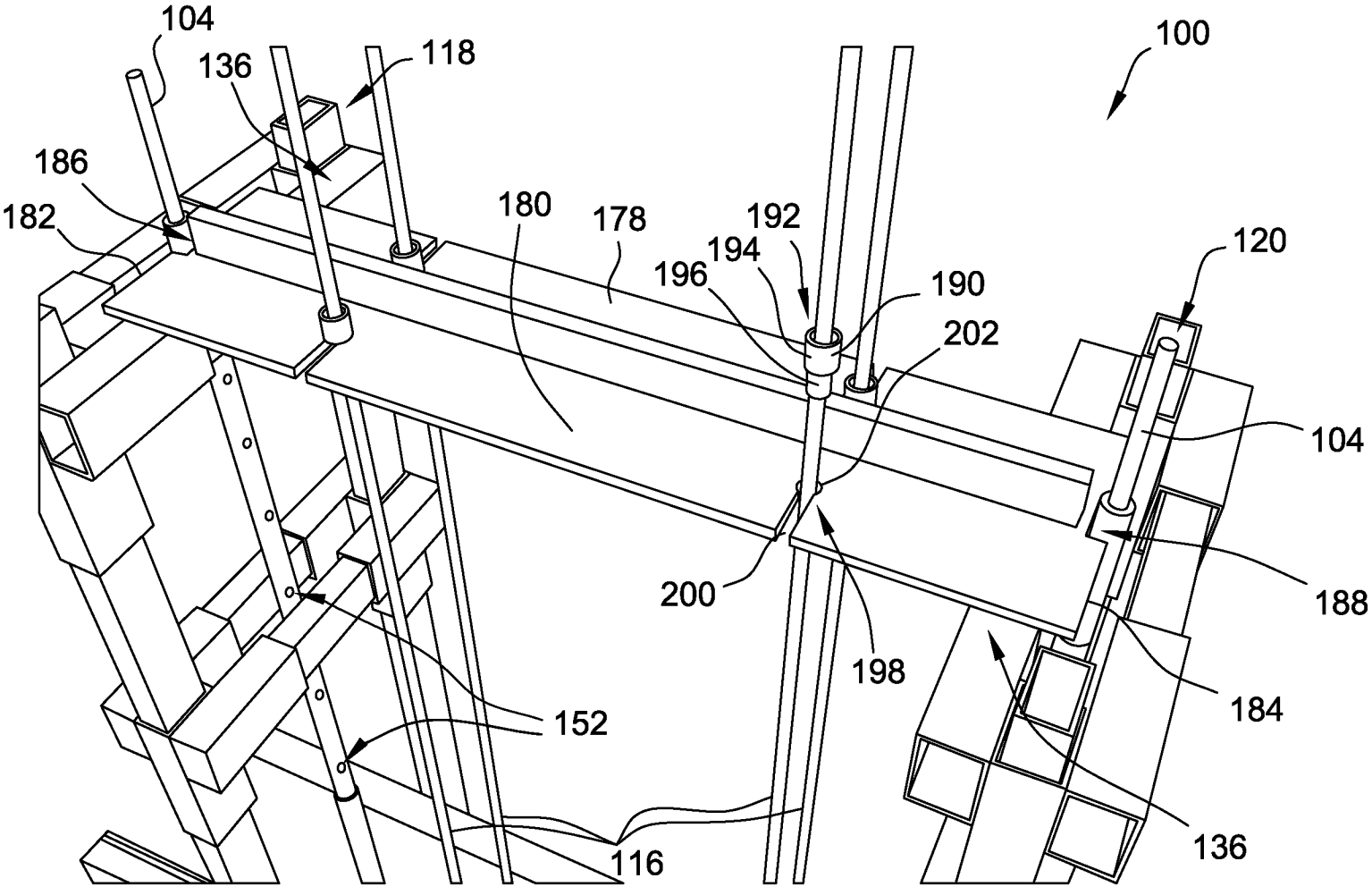
FIG. 6 is a schematic, perspective view of a portion of the slip form construction system shown in FIG. 1.

FIG. 6 is a schematic, perspective view of a portion of slip form construction system 100 shown in FIG. 1. In the exemplary embodiment slip form construction system 100 includes a reinforcing bar template 178 extending between first slip form assembly 118 and second slip form assembly 120. More specifically, in the exemplary embodiment, reinforcing bar template 178 includes a body 180 extending between a first end 182, resting on and supported by first spreader assembly 136 of first slip form assembly 118, to a second end 184, resting on and supported by first spreader assembly 136 of second slip form assembly 120. In the exemplary embodiment, first end 182 defines a first notch 186 and second end 184 defines a second notch 188. First notch 186 and second notch 188 are each sized to receive at least a portion of respective lifting poles 104 therein to maintain reinforcing bar template 178 in position with respect to first slip form assembly 118 and second slip form assembly 120 and to facilitate slidably moving reinforcing bar template 178 along lifting poles 104 during operation.

In the exemplary embodiment, reinforcing bars 116 are each slidably received within a bushing 190. In the exemplary embodiment, bushings 190 are generally tubular shape and define a passageway 192 sized to slidably receive reinforcing bars 116 therein. Bushings 190 each include a first circumferential section 194 and a narrower, second circumferential section 196 positioned axially adjacent first circumferential section 194 and sized to have a smaller diameter than first circumferential section 194. First circumferential section 194 is coupled to second circumferential section 196 such that passageway 192 extends through each of first circumferential section 194 and second circumferential section 196.

In the exemplary embodiment, body 180 defines a plurality of guide notches 198 between first end 182 and second end 184. Guide notches 198 are each sized to receive a portion of reinforcing bars 116 therein to maintain an even positioning of reinforcing bars 116 relative to one another within wall 101 (shown in FIG. 1) during construction. In particular, in the exemplary embodiment, guide notches 198 each include a channel portion 200 extending to a slot portion 202. Channel portion 200 is sized to receive reinforcing bars 116 therein. More specifically, channel portion 200 is sized to allow a longitudinally extending reinforcing bar 116 to be inserted transversely through channel portion 200 and into slot portion 202. In the exemplary embodiment, reinforcing bar template 178 defines four guide notches 198 each receiving one reinforcing bars 116 therein. In alternative embodiments, reinforcing bar template 178 defines any number of guide notches 198 that enable reinforcing bar template 178 to function as described herein.

In the exemplary embodiment, slot portion 202 is sized to axially receive second circumferential section 196 of bushing 190 and to inhibit axial insertion of first circumferential section 194 therein. In particular, in the exemplary embodiment, slot portion 202 has a smaller circumference than first circumferential section 194 such that, when second circumferential section 196 is axially inserted into slot portion 202, body 180 engages and supports first circumferential section 194. Furthermore, channel portion 200 is sized to inhibit transverse movement of second circumferential section 196 therein. More specifically, in the exemplary embodiment, channel portion 200 has a width that is less than a diameter of second circumferential section 196 such that, when second circumferential section 196 is axially inserted into slot portion 202, transverse movement of reinforcing bar 116 and bushing 190 into channel portion 200 is prevented.

During operation, as first slip form assembly 118 and second slip form assembly 120 are longitudinally moved relative to reinforcing bars 116, reinforcing bar template 178 is likewise moved in the longitudinal direction. In the exemplary embodiment, the engagement between body 180 and first circumferential section 194 drives slidable movement of bushing 190 along reinforcing bar 116 as reinforcing bar template 178 is lifted.

In the exemplary embodiment, lifting pole 104 is substantially hollow and defines a plurality of apertures 152 equidistantly spaced along the length of lifting pole 104. More specifically, in the exemplary embodiment, apertures 152 each include a corresponding circumferentially opposite aperture (not shown) defined in lifting pole 104 to facilitate pin locking engagement through apertures 152. In the exemplary embodiment, apertures 152 are each spaced approximately 6 inches apart from each of the closest longitudinal apertures 152. In alternative embodiments, apertures 152 are spaced from one another any distance that enables slip form assemblies 102 to function as described herein.

Figure 7:
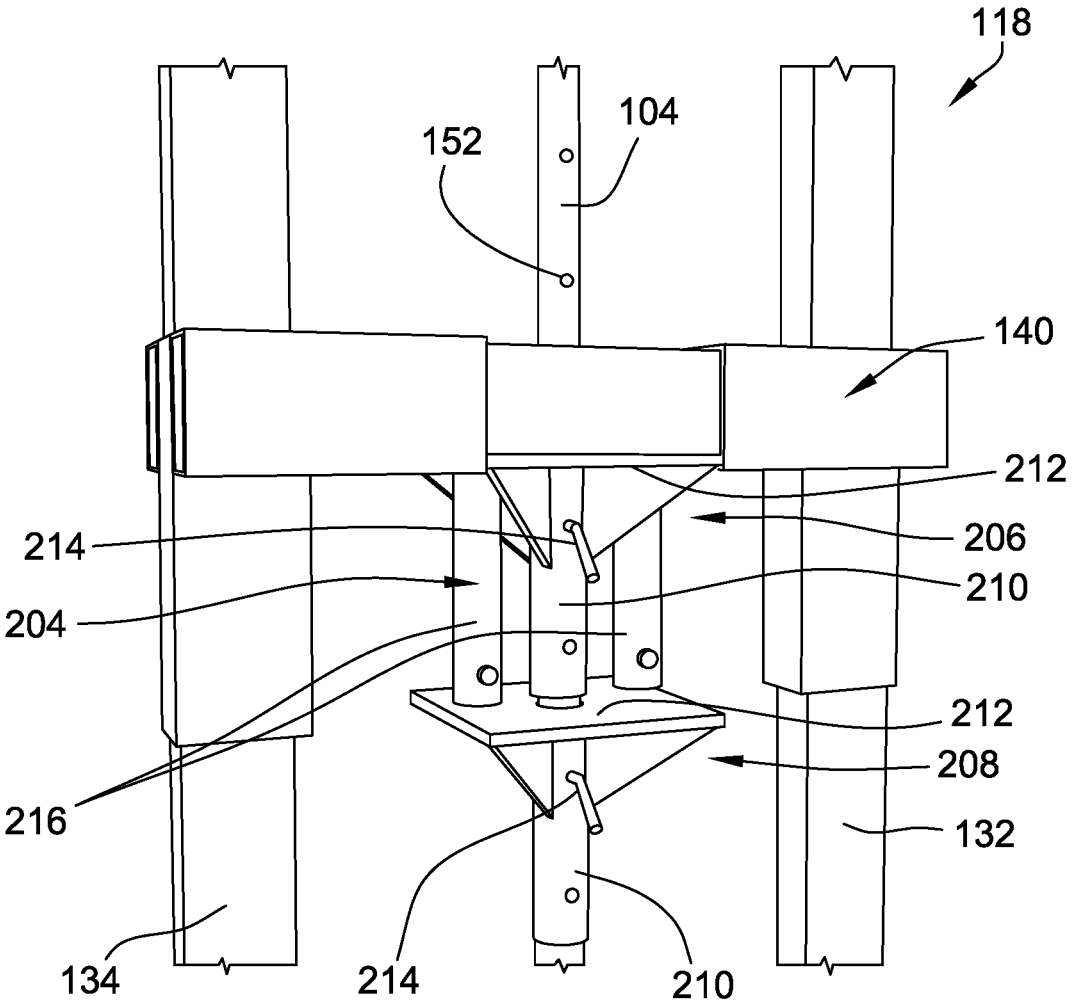
FIG. 7 is a schematic, perspective view of a portion of the slip form assembly shown in FIG. 3 including a lifting mechanism in a retracted position.
Figure 8:
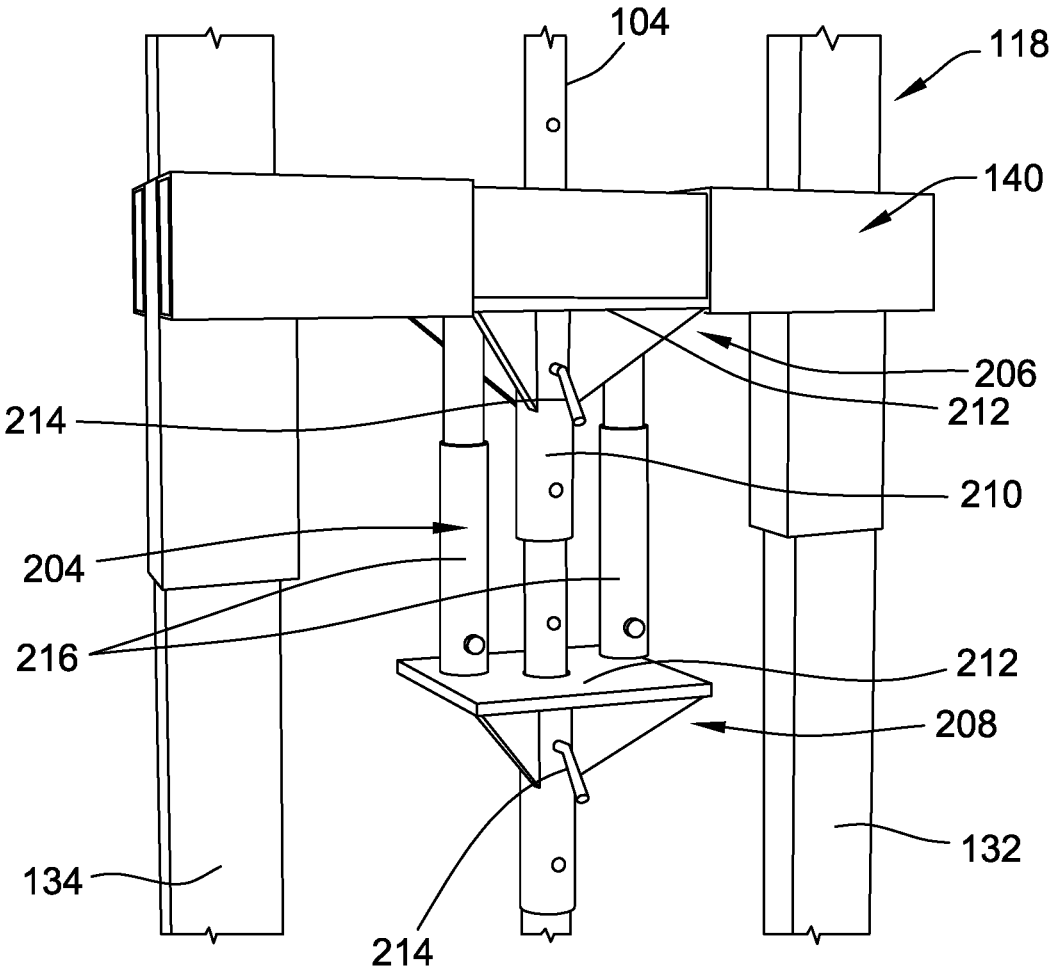
FIG. 8 is a schematic, perspective view of the portion of the slip form assembly shown in FIG. 7 with the lifting mechanism in an extended position.

FIG. 7 is a schematic, perspective view of a portion of first slip form assembly 118 shown in FIG. 3 including a lift mechanism 204 in a retracted position. FIG. 8 is a schematic, perspective view of the portion of first slip form assembly 118 shown in FIG. 7 with lift mechanism 204 in an extended position.

In the exemplary embodiment, first slip form assembly 118 includes a first support assembly 206, a second support assembly 208, and lift mechanism 204 coupled to first support assembly 206 and second support assembly 208. In the exemplary embodiment, first support assembly 206 is slidably coupled to lifting pole 104 and is configured to support second spreader assembly 140 on lifting pole 104. More specifically, in the exemplary embodiment, first support assembly 206 includes a sleeve portion 210 sized to slidably receive lifting pole 104 therein and a lifting plate 212 coupled to sleeve portion 210 and sized to engage and support second spreader assembly 140 on lifting pole 104. In the exemplary embodiment, first support assembly 206 further includes a pin key 214 configured to support sleeve portion 210 longitudinally relative to lifting pole. More specifically, in the exemplary embodiment, pin key 214 is sized to be inserted into apertures 152 (shown in FIG. 6) of lifting pole 104 to removably couple sleeve portion 210 in a fixed longitudinal position along lifting pole 104.

In the exemplary embodiment, second support assembly 208 includes substantially the same configuration as first support assembly 206. For example, in the exemplary embodiment, second support assembly 208 includes a lifting plate 212 coupled to a sleeve portion 210. Second support assembly 208 is coupled to lifting pole 104 via an additional pin key 214 longitudinally below first support assembly 206 to facilitate supporting lift mechanism 204 between first support assembly 206 and second support assembly 208.

In the exemplary embodiment, lift mechanism 204 is configured to drive longitudinal movement of first support assembly 206 along lifting pole 104 relative to second support assembly 208. More specifically, in the exemplary embodiment, lift mechanism 204 includes two jacks 216 supported on lifting plate 212 of second support assembly 208. Jacks 216 are extendable between a retracted position (shown in FIG. 7) and an extended position (shown in FIG. 8) and are configured to engage lifting plate 212 of first support assembly 206 and be moved into the extended position (shown in FIG. 8) to drive longitudinal movement of first support assembly 206 along lifting pole, and thereby, drive longitudinal movement of second spreader assembly 140, yokes 132, 134, and forms 108, 110 (shown in FIG. 3) along lifting pole 104. In the exemplary embodiment, jacks 216 are hydraulically actuated. In alternative embodiment, jacks are pneumatically actuated. In yet further alternative embodiments, lift mechanism 204 includes any lifting device that enables first slip form assembly 118 to function as described herein.

Referring to FIG. 8, during operation, when lift mechanism 204 is in the extended position, pin key 214 is moved to a longitudinally adjacent aperture to couple first support assembly 206 to lifting pole 104 in the extended position. After coupling first support assembly 206 to lifting pole 104, lift mechanism 204 is lowered and removed from second support assembly 208. Lift mechanism 204 is then positioned on second support assemblies of adjacent slip form assemblies 102 (shown in FIG. 1) to facilitate lifting adjacent slip form assemblies 102. Accordingly, in the exemplary embodiment, a single lift mechanism 204 is used to lift each first slip form assembly 118 of slip form construction system 100. In other embodiments, each first slip form assembly 118 includes a respective lift mechanism 204. In further alternative embodiments, slip form construction system 100 includes any number of lift mechanisms 204 that enable slip form construction system 100 to function as described herein.

Figure 10:
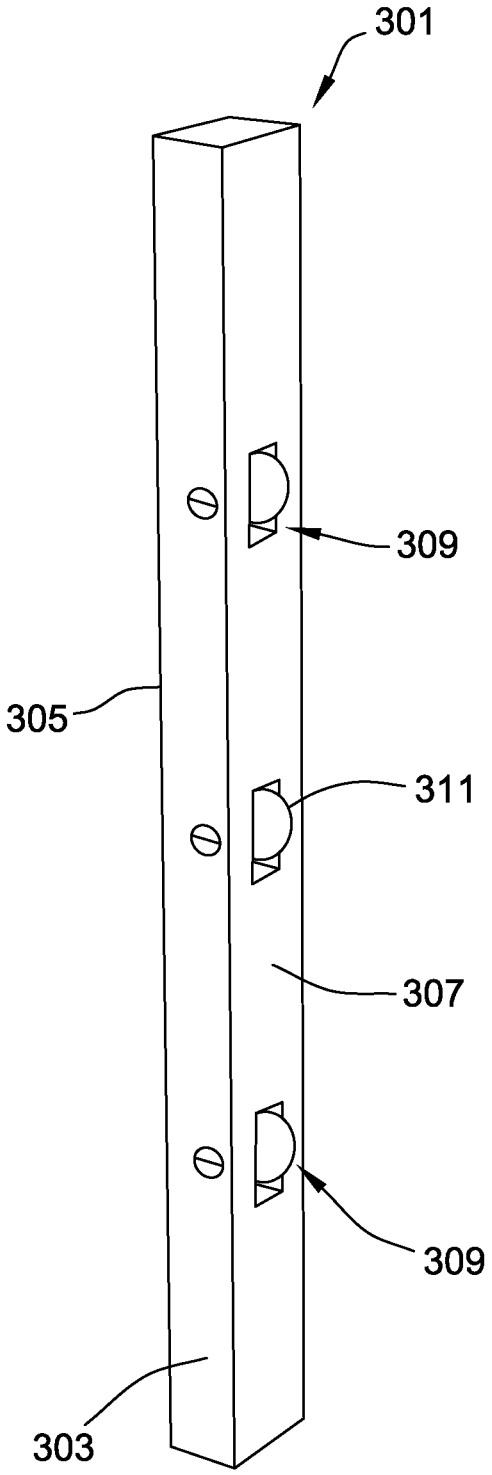
FIG. 10 is a schematic, perspective view of a roller assembly for use in the slip form assembly shown in FIG. 9.

FIG. 9 is a schematic, perspective view of a portion of an alternative slip form assembly 318 for use in the slip form construction system 100 shown in FIG. 1. FIG. 10 is a schematic, perspective view of a roller assembly 301 for use in slip form construction assembly 318 shown in FIG. 9. First slip form assembly 318 is substantially the same as first slip form assembly 118 described above with respect to FIGS. 1-8 except that, in the exemplary embodiment, first slip form assembly 318 includes an outer form 310 having roller assembly 301. In the exemplary embodiment, inner form 308 of first slip form assembly includes roller assembly 301 configured in substantially the same manner as roller assembly 301 of outer form 310 described below.

In the exemplary embodiment, outer form 310 of first slip form assembly 318 extends to a second end 326 defined by roller assembly 301. In other words, in the exemplary embodiment, a planar end face (not shown) of roller assembly 301 defines second end 326 of outer form 310 of first slip form assembly 318. An outer form 310 of a second slip form assembly 320 is positioned adjacent outer form 310 of first slip form assembly 318 in end-to-end contact with second end 326 of outer form 310 of first slip form assembly 318 or, more specifically, with roller assembly 301. In particular, in the exemplary embodiment, roller assembly 301 is coupled to a form body 358 of first slip form assembly 318 and is positioned to extend from form body 358 and abut a first end 324 of outer form 310 of second slip form assembly 320. In alternative embodiments, roller assembly 301 is coupled to form body 358 in any manner that enables roller assembly 301 to function as described herein.

Roller assembly 301 is configured to reduce friction between forms 310 when slip form assemblies 318, 320 are raised relative to one another. In particular, referring to FIG.

10, in the exemplary embodiment, roller assembly 301 includes a housing 303 having a first side 305 configured to be coupled to form. Housing 303 also includes a second side 307, opposite first side 305, configured to face an end of an opposing form (e.g., outer form 310 of second slip form assembly 320). Housing 303 defines recesses 309 in second side 307 each partially containing a rolling element 311 therein. In the exemplary embodiment, rolling elements 311 are wheels configured to rotate about an axel (not shown) positioned within housing 303. Rolling elements 311 are longitudinally along second side 307 to facilitate rolling engagement with an opposing form at multiple points along the length of roller assembly 301. In alternative embodiments, rolling elements 311 cover the entire length of roller assembly 301 such that roller assembly 301 is configured to only contact an opposing form via rolling elements 311. In further alternative embodiments, rolling elements are arranged on housing 303 in any manner that enables roller assembly 301 to function as described herein.

Referring back to FIG. 9, in the exemplary embodiment, a surface panel 360 is coupled to roller assembly 301 on a second side (similar to second side 168 of outer form 110 shown in FIG. 5) of outer form 310. In the exemplary embodiment, during operation, rolling elements 311 do not substantially come into contact with concrete poured into the cavity 112 (shown in FIG. 4) but rather are at least partially shielded from concrete by the surface panel (not shown) and housing 303. In alternative embodiments, rolling elements 311 are shielded from the poured concrete in any manner that enables roller assembly 301 to function as described herein.

Figure 11:
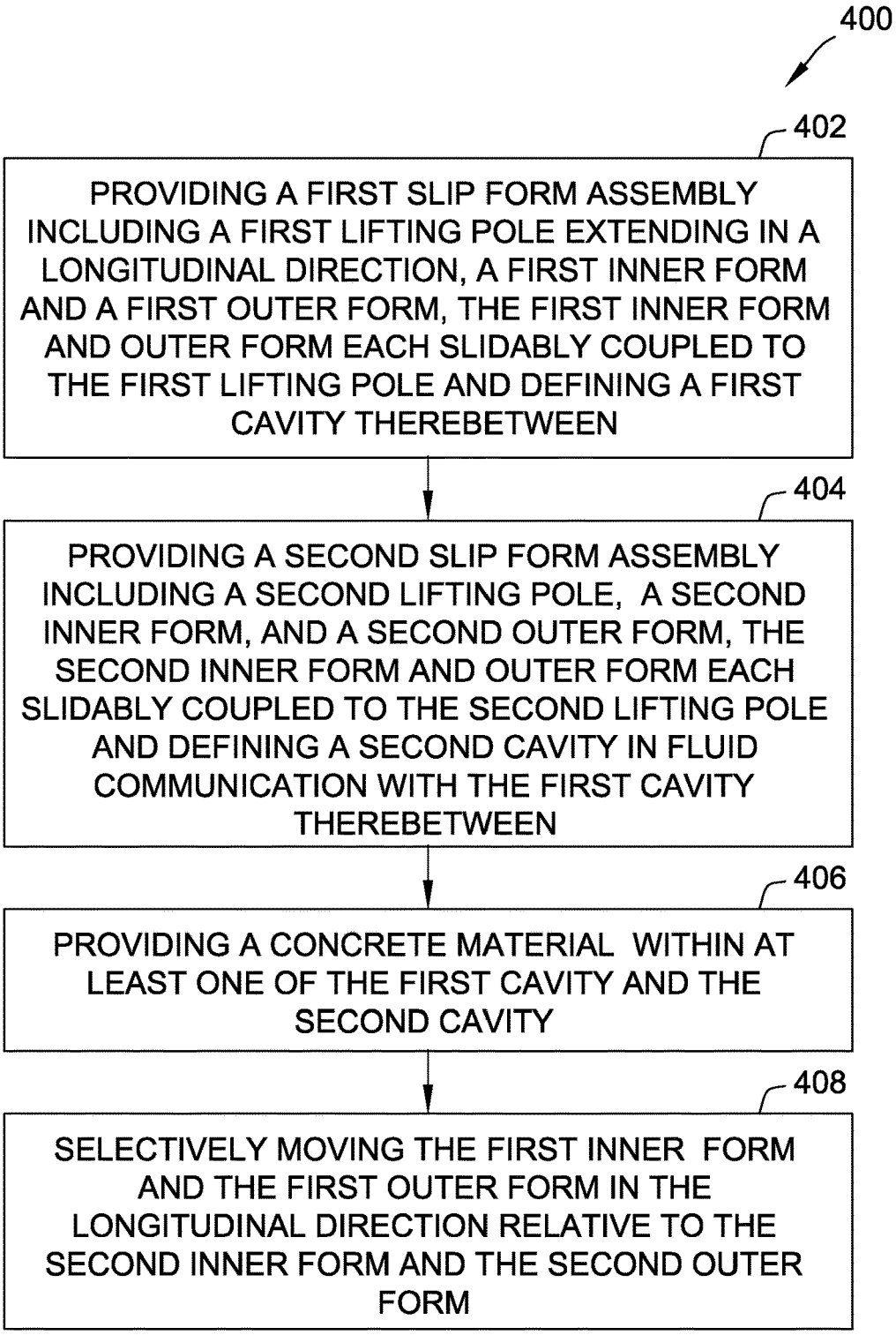
FIG. 11 is a flow diagram of an exemplary method of assembling a concrete wall.

FIG. 11 is a flow diagram of an exemplary method 400 of assembling a concrete wall (e.g., concrete wall 101 shown in FIG. 1). Method 400 includes providing 402 a first slip form assembly (e.g., first slip form assembly 118 shown in FIG. 2) including a first lifting pole (e.g., lifting pole 104 shown in FIG. 2) extending in a longitudinal direction, a first inner form (e.g., inner form 108 shown in FIG. 2), and a first outer form (e.g., outer form 110 shown in FIG. 2), the first inner form and outer form each slidably coupled to the first lifting pole and defining a first cavity (e.g., cavity 112 shown in FIG. 2) therebetween. Method 400 also includes providing 404 a second slip form assembly (e.g., second slip form assembly 120 shown in FIG. 2) including a second lifting pole, a second inner form, and a second outer form, the second inner form and outer form each slidably coupled to the second lifting pole and defining a second cavity (e.g., cavity 112 shown in FIG. 2) in fluid communication with the first cavity therebetween. Method 400 further includes providing 406 a concrete material within at least one of the first cavity and the second cavity and selectively moving 408 the first inner form and the first outer form in the longitudinal direction relative to the second inner form and the second outer form.

Figure 12:
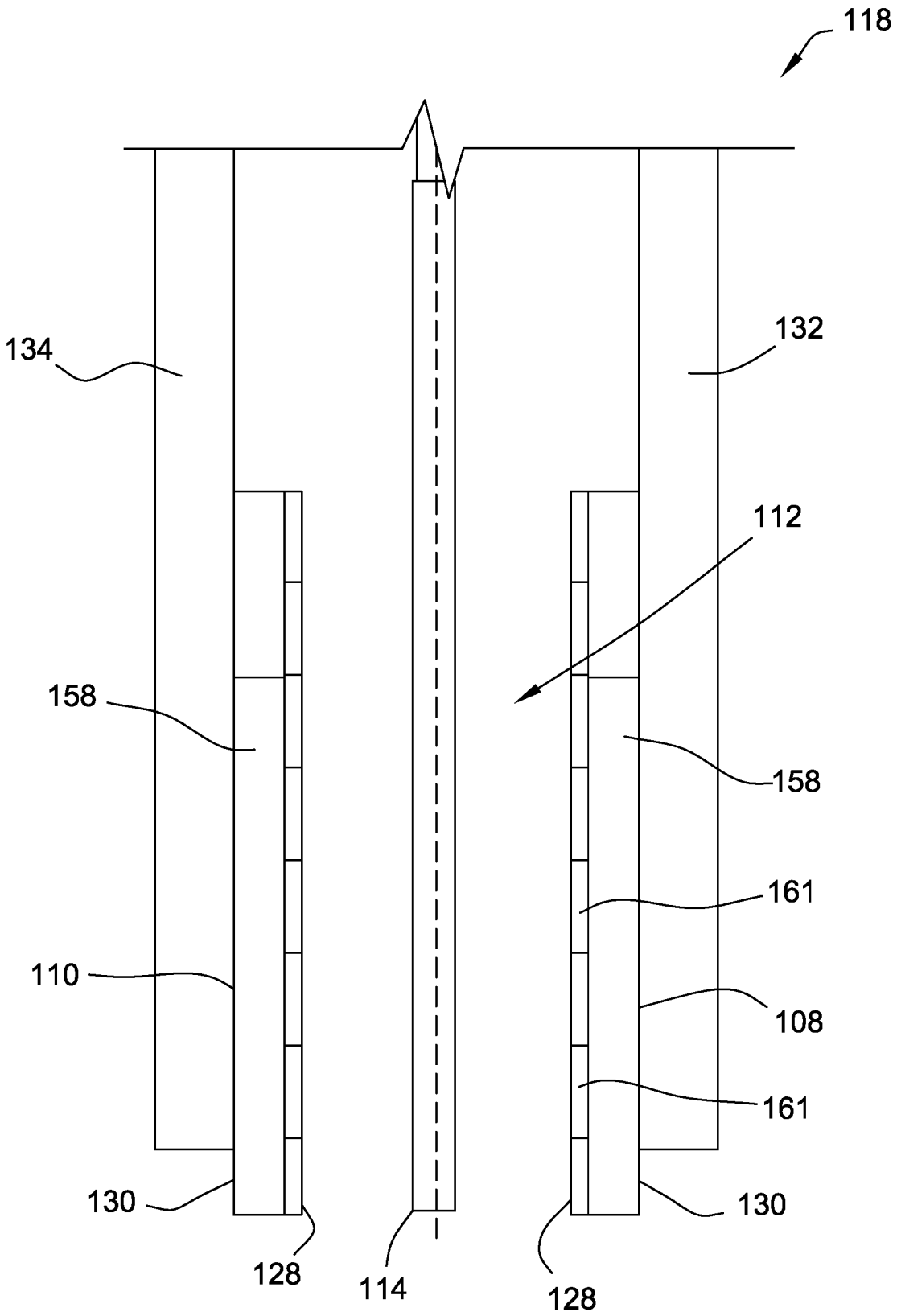
FIG. 12 is an enlarged schematic, end view of an alternative slip form assembly for use in the slip form construction system shown in FIG. 1.

FIG. 12 is an enlarged schematic, end view of an alternative slip form assembly 118 for use in slip form construction system 100 shown in FIG. 1. In the exemplary embodiment, slip form assembly 118 is substantially the same as first slip form assembly 118, described above with respect to FIG. 3, except as described below. In particular, in the exemplary embodiment, slip form assembly 118 includes a plurality of stacked panels 161 positioned in contact with form bodies 158 of inner form 108 and outer form 110. Stacked panels 161 define respective inner surfaces 128 of inner form 108 and outer form 110. A cavity 112 is defined between panels 161 for receiving poured concrete therein. Stacked panels 161 are configured to engage concrete poured within cavity. In the exemplary embodiment, stacked panels are formed of an ultra-high molecular weight ("UHMW") polyethylene. In alternative embodiments, stacked panels 161 are formed of any material that enables slip form assembly 118 to function as described herein.

In the exemplary embodiment, unlike first slip form assembly 118 described above with respect to FIG. 3, slip form assembly 118 does not include a unitary panel (e.g., surface panel 160, shown in FIG. 5) fixably coupled to and covering the height of form bodies 158. Rather, in the exemplary embodiment, stacked panels 161 are configured to directly contact form bodies 158 and configured to facilitate longitudinal movement of form bodies 158 relative to stacked panels 161. Moreover, in the exemplary embodiment, stacked panels 161 each extend only a portion of the height of form bodies 158. In particular, in the exemplary embodiment, stacked panels 161 each extend a height of approximately six inches. In alternative embodiments, stacked panels 161 extend any height that enables stacked panels 161 to function as described herein. In further alternative embodiments, a surface panel (e.g., surface panel 160, shown in FIG. 5) is fixably coupled to form bodies 158 and panel stacks 161 are configured to be positioned between, and in direct contact with, the surface panel and the concrete.

In the exemplary embodiment, stacked panels 161 are each removably coupled to an adjacent stacked panel 161. In particular, stacked panels 161 each include a coupling features (e.g., a latch and a catch, not shown) configured to releasably engage coupling features of an adjacent stacked panel 161 such that stacked panels 161 are collectively supported on form bodies 158 and held-in place during a pouring operation. In alternative embodiments, stacked panels 161 are held in place during a pouring operation in any manner that enables slip form assembly 118 to function as described herein.

During operation, prior to beginning an initial pour, an operator may position stacked panels 161 adjacent respective form bodies 158 of inner form 108 and outer form 110. Concrete is then poured in six inch increments until the level of concrete reaches the top level of forms 108, 110. As forms 108, 110 are raised, bottom panels 161 of stacked panels 161 are exposed beneath raised forms 108, 110. Bottom panels 161 may then be detached from an adjacent panel 161 (e.g., by releasing the coupling features from an adjacent panel 161). A new top panel 161 may also be added on top of the stacked panels 161 to facilitate pouring additional concrete. As a result, stacked panels 161 may be cleaned or replaced prior to being inserted at the top of form body 158 to prevent any hardened concrete remaining on stacked panels 161 from leaving imprints in the hardening concrete. In the exemplary embodiment, stacked panels 161 collectively define a generally planar inner surface 128. In alternative embodiments, stacked panels 161 may be texturized to facilitate forming textured surfaces in the concrete wall 101 (shown in FIG. 1).

An exemplary technical effect of the methods, systems, and apparatus described herein includes at least one of: (a) improved ease of assembly in constructing concrete structures; (b) reduced downtime required to construct concrete structures; (c) improved accuracy in placing reinforcement members (e.g., reinforcing bars) within concrete structures; (d) improved worker safety during construction; (e) reduced machinery (e.g., a crane) required to construct concrete structure; and (f) reduced overall construction time.

Exemplary embodiments of slip form assemblies, slip form construction systems, and methods for assembling a concrete wall, are described above in detail. The methods and systems are not limited to the specific embodiments described herein, but rather, components of systems and/or steps of the methods may be utilized independently and separately from other components and/or steps described herein. For example, the method may also be used in combination with other slip form assemblies and/or slip form construction systems, and are not limited to practice only with the slip form assemblies and slip form construction systems as described herein. Rather, the exemplary embodiment can be implemented and utilized in connection with many other slip form construction systems.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A slip form assembly for use in a slip form construction system, said slip form assembly comprising:

a lifting pole extending in a longitudinal direction;

an inner form slidably coupled to said lifting pole and extending in a lengthwise direction perpendicular to the longitudinal direction between a first end and a second end, said first end configured for end-to-end contact with an adjacent end of an adjacent inner form;

an outer form slidably coupled to said lifting pole opposite said inner form and defining a cavity for casting a portion of a wall therebetween, said outer form extending parallel to said inner form between a first end and a second end, said first end of said outer form configured for end-to-end contact with an adjacent end of an adjacent outer form, said inner form and said outer form being moveable along said lifting pole in the longitudinal direction relative to the respective ends of the adjacent inner form and outer form; and a reinforcing bar template coupled to said lifting pole, said reinforcing bar template defining a plurality of guide apertures each sized to receive a reinforcing bar therein.

2. The slip form assembly in accordance with claim 1, further comprising:

an inner yoke fixedly coupled to said inner form and extending in the longitudinal direction therefrom;

an outer yoke fixedly coupled to said outer form and extending in the longitudinal direction therefrom; and a spreader bracket coupled to said inner yoke and said outer yoke and extending therebetween, said spreader bracket defining an opening, wherein said lifting pole extends through the opening in said spreader bracket.

3. The slip form assembly in accordance with claim 2 further comprising a lifting plate slidably coupled to said lifting pole, said lifting plate sized to engage said spreader bracket to support said spreader bracket on said lifting pole.

4. The slip form assembly in accordance with claim 3, wherein said lifting plate is selectively moveable in the longitudinal direction along said lifting pole to facilitate moving said inner form and said outer form in the longitudinal direction.

5. The slip form assembly of claim 1, wherein said inner form and said outer form each extend a height in the longitudinal direction, said inner form comprising a first surface panel defining an inner surface of said inner form, wherein said outer form comprises a second surface panel defining an inner surface of said outer form, and wherein said first surface panel and said second surface panel are configured to slidably engage the portion of the wall.

6. The slip form assembly of claim 5, wherein said first panel comprises a plurality of longitudinally stacked panels, wherein each panel of said panels is removably coupled to an adjacent panel of said plurality of panels.

7. The slip form assembly of claim 1, wherein at least one of said inner form and said outer form comprises a rolling assembly defining said first end of said at least one of said inner form and said outer form, said rolling assembly comprising a housing and a rolling element rotatably coupled to said housing.

8. The slip form assembly of claim 7, wherein said rolling element is oriented to rotatably engage a corresponding end of an adjacent form.

9. The slip form assembly of claim 1, wherein said second end of said inner form is configured for end-to-end contact with an adjacent end of an adjacent inner form, and wherein said second end of said outer form is configured for end-to-end contact with an adjacent end of an adjacent outer form.

10. A slip form construction system comprising:

a first slip form assembly comprising:

a first lifting pole extending in a longitudinal direction;

a first inner form slidably coupled to said first lifting pole; and a first outer form slidably coupled to said first lifting pole opposite said first inner form and defining a first cavity for casting a first portion of a wall therebetween; and a second slip form assembly comprising:

a second lifting pole extending in the longitudinal direction;

a second inner form slidably coupled to said second lifting pole;

a second outer form slidably coupled to said second lifting pole opposite said second inner form and defining a second cavity in fluid communication with the first cavity for casting a second portion of the wall therebetween, wherein said first inner form and said first outer form are moveable about said first lifting pole in the longitudinal direction to facilitate moving said first inner form and said first outer form in the longitudinal direction relative to said second inner form and said second outer form; and a reinforcing bar template coupled to said first lifting pole and to said second lifting pole, said reinforcing bar template defining a plurality of guide apertures each sized to receive a reinforcing bar therein.

11. The slip form construction system in accordance with claim 10, wherein said first slip form assembly further comprises:

an inner yoke fixedly coupled to said first inner form and extending in the longitudinal direction therefrom;

an outer yoke fixedly coupled to said first outer form and extending in the longitudinal direction therefrom; and a spreader bracket coupled to said inner yoke and said outer yoke and extending therebetween, said spreader bracket defining an opening, wherein said first lifting pole extends through the opening in said spreader bracket.

12. The slip form construction system in accordance with claim 11 further comprising a lifting plate slidably coupled to said first lifting pole, wherein said lifting plate sized to engage said spreader bracket to support said spreader bracket on said first lifting pole.

13. The slip form construction system in accordance with claim 12, wherein said lifting plate is selectively moveable in the longitudinal direction along said first lifting pole to facilitate moving said first inner form and said first outer form in the longitudinal direction.

14. The slip form construction system in accordance with claim 10, wherein said first inner form comprises a first surface panel and said first outer form comprises a second surface panel positioned to face said first surface panel, wherein said first surface panel and said second surface panel are formed of an ultra-high-molecular-weight polyethylene.

15. A method of assembling a concrete wall comprising:

providing a first slip form assembly including a first lifting pole extending in a longitudinal direction, a first inner form, and a first outer form, the first inner form and outer form each slidably coupled to the first lifting pole and defining a first cavity therebetween;

providing a second slip form assembly including a second lifting pole, a second inner form, and a second outer form, the second inner form and outer form each slidably coupled to the second lifting pole and defining a second cavity in fluid communication with the first cavity therebetween;

coupling a reinforcing bar template to the first lifting pole and to the second lifting pole, wherein the reinforcing bar template defines a plurality of guide apertures that are each sized to receive a reinforcing bar therein;

providing a concrete material within at least one of the first cavity and the second cavity; and selectively moving the first inner form and the first outer form in the longitudinal direction relative to the second inner form and the second outer form.

16. The method in accordance with claim 15 further comprising selectively moving the second inner form and the second outer form in the longitudinal direction relative to the first inner form and the first outer form.

17. The method in accordance with claim 15, wherein said selectively moving the first inner form and the first outer form comprises raising the first inner form and the first outer form at least partially above the second inner form and the second outer form, wherein said providing the concrete material within at least one of the first cavity and the second cavity comprises providing the concrete material within the first cavity prior to said selectively moving the first inner form and the first outer form.

18. The method in accordance with claim 17 further comprising providing, after raising the first inner form and the first outer form, the concrete material within the second cavity defined between the second inner form and the second outer form as the first inner form and the first outer form are raised relative to the second inner form and the second outer form.

19. The method in accordance with claim 15 wherein coupling a reinforcing bar template further comprises coupling the reinforcing bar template to the first and second lifting poles such that as the first and second slip assemblies are moved longitudinally, the reinforcing bar template is likewise moved longitudinally.

20. The method in accordance with claim 15 further comprising coupling a surface panel having a low coefficient of friction with concrete between the inner and outer forms to facilitate slidably moving at least one of the inner and outer forms in the longitudinal direction relative to hardened concrete.

* * * * *